US011069370B2

(12) United States Patent
Chai et al.

(10) Patent No.: US 11,069,370 B2
(45) Date of Patent: Jul. 20, 2021

(54) TAMPERING DETECTION AND LOCATION IDENTIFICATION OF DIGITAL AUDIO RECORDINGS

(71) Applicants: University of Tennessee Research Foundation, Knoxville, TN (US); UT-Battelle, LLC, Oak Ridge, TN (US)

(72) Inventors: Jidong Chai, Knoxville, TN (US); Yilu Liu, Knoxville, TN (US); Jiecheng Zhao, Knoxville, TN (US); Wenxuan Yao, Knoxville, TN (US); Thomas J. King, Oak Ridge, TN (US)

(73) Assignees: UNIVERSITY OF TENNESSEE RESEARCH FOUNDATION, Knoxville, TN (US); UT-BATTELLE, LLC, Oak Ridge, TN (US)

( * ) Notice: Subject to any disclaimer, the term of this patent is extended or adjusted under 35 U.S.C. 154(b) by 1224 days.

(21) Appl. No.: 14/992,974

(22) Filed: Jan. 11, 2016

(65) Prior Publication Data

US 2017/0200457 A1 Jul. 13, 2017

(51) Int. Cl.

| | |
|---|---|
| ***G10L 25/51*** | (2013.01) |
| ***G10L 25/30*** | (2013.01) |
| ***G10L 25/18*** | (2013.01) |

(52) U.S. Cl.

CPC ..... *G10L 25/51* (2013.01); *G10L 25/18* (2013.01); *G10L 25/30* (2013.01)

(58) Field of Classification Search

CPC ..... H04N 2005/91342; H04N 5/913; H04N 5/04; H04N 9/8205; G06F 17/30743; G06F 17/30784; G06Q 50/265; G10L 21/0232; G10L 21/038; G10L 25/30; G10L 25/51; G11B 20/10259; G11B 20/10527

USPC ..... 386/252; 700/94; 705/325

See application file for complete search history.

(56) References Cited

U.S. PATENT DOCUMENTS

2015/0052073 A1* 2/2015 Panczenko ..... G06F 17/30784 705/325

OTHER PUBLICATIONS

Chai et al., "Tampering Detection of Digital Recordings using Electric Network Frequency and Phase Angle", Audio Engineering Society Convention Paper, 135th Convention, Oct. 2013, pp. 1-8.*

(Continued)

*Primary Examiner* — Duc Nguyen
*Assistant Examiner* — Alexander L Eljaiek
(74) *Attorney, Agent, or Firm* — Myers Bigel, P.A

(57) ABSTRACT

Systems and methods for detecting a tampering and identifying a location of a digital recording are provided. A frequency sequence and a phase angle sequence may be extracted from the digital recording. A portion of the frequency sequence may be matched to one of a plurality of reference frequency sequences, and a portion of the phase angle sequence may be matched to one of a plurality of reference phase angle sequences. Tampering of the digital recording may be detected when the frequency and phase sequences differ from the matched reference sequences. Moreover, a noise sequence may be extracted from the extracted frequency sequence. A location of the digital recording may be identified by matching the noise sequence to one of a plurality of noise sequences of the plurality of reference frequency sequences.

19 Claims, 16 Drawing Sheets

(56) References Cited

OTHER PUBLICATIONS

Yuming Liu et al., "Application of Power System Frequency for Digital Audio Authentication", IEEE Transactions on Power Delivery, Oct. 2012, pp. 1820-1828, vol. 27, No. 4.
Jidong Chai et al., "Tampering Detection of Digital Recordings using Electric Network Frequency and Phase Angle", Audio Engineering Society Convention Paper—presented at the 135th Convention, Oct. 2013, pp. 1-8, New York, NY.
Jidong Chai et al., "Application of Wide Area Power System Measurement for Digital Authentication", Proceedings of the 2016 IEEE PES Transmission and Distribution Conference and Exposition, May 2-5, 2016.
Yilu Liu et al., "Differentiate and Identify Electrical Frequency from Different Outlets", May 21, 2015.
Jidong Chai et al., "Tampering Detection of Digital Recordings using Electric Network Frequency and Phase Angle"; Audio Engineering Society Convention Paper 8998—presented at the 135th Convention, Oct. 2013, pp. 1-8, New York, NY.
Yuming Liu et al., "A Study of the Accuracy and Precision of Quadratic Frequency Interpolation for ENF Estimation", AES 46th International Conference, Jun. 2012, pp. 1-5, Denver, USA.
Ling Fu et al., "An Improved Discrete Fourier Transform-Based Algorithm for Electric Network Frequency Extraction", IEEE Transactions on Information Forensics and Security, Jul. 2013, pp. 1173-1181, vol. 8, No. 7.
Zhiyong Yuan et al., "Effects of Oscillator Errors on Electric Network Frequency Analysis", AES 46th International Conference, Jun. 2012, pp. 1-5, Denver, USA.
Yuming Liu et al., "Power Grid Frequency Data Conditioning Using Robust Statistics and B-spline Functions", IEEE Power and Energy Society General Meeting, Jul. 22-26, 2012, 6 pages.
Jidong Chai et al., "Source of ENF in Battery-powered Digital Recordings", Audio Engineering Society Convention Paper—presented at the 135th Convention, Oct. 2013, pp. 1-7, New York, NY.
Zhiyong Yuan et al., "Using Simple Monte Carlo Methods and a Grid Database to Determine the Operational Parameters for the ENF Matching Process", AES 46th International Conference, Jun. 2012, pp. 1-5, Denver, USA.
Yuming Liu et al., "Wide-area Frequency as a Criterion for Digital Audio Recording Authentication", Power and Energy Society General Meeting, 2011 IEEE, Jul. 24-29, 2011, pp. 1-7.

* cited by examiner

100

300

400

1400

1500

TAMPERING DETECTION AND LOCATION IDENTIFICATION OF DIGITAL AUDIO RECORDINGS

STATEMENT REGARDING FEDERALLY SPONSORED RESEARCH OR DEVELOPMENT

This invention was made with government support under grants from the National Science Foundation, Award No. EEC-1041877, the Department of Justice, National Institutes of Justice, Award No. 2009-DN-BX-K233, and the Department of Energy, Award No. DE-AC05-00OR22725. The U.S. Government has certain rights in this invention.

BACKGROUND

The present disclosure generally relates to forensic authentication of digital audio recordings.

An important task for forensic authentication of digital audio recordings is to determine whether the recordings have been tampered with. Unlike analog recordings, digital recordings may be altered using sophisticated editing software without leaving obvious signs of tampering. Since the signal characteristics of digital recordings are different from those of analog recordings, traditional methods for authenticating analog recordings fail for digital ones.

An electric network frequency (ENF) criterion has been shown to be a promising technique in detecting tampering of digital audio recordings. An ENF sequence may exist in some digital audio recordings when corresponding recording devices are mains-powered (e.g., directly connected to a utility power grid through a conventional outlet) or used in proximity of other mains-powered equipment even if the recording devices are battery-powered. Such recording devices capture not only the audio data but also, from the power grid, some 50/60-Hz sequence when mains-powered or 100/120-Hz sequence when battery-powered. The ENF criterion comprises extracting an ENF sequence from a recording and matching the ENF sequence against a frequency reference database to find the production time and tampering information, if any, of the recording. However, the reliability of the detection depends on the algorithm used to extract the ENF sequence.

It has also been shown that sudden changes in electric network phase angle sequences extracted from digital audio recordings may be used to detect tampering of the digital audio recordings without a phase angle reference database. However, disturbances in a power grid may occasionally cause sudden changes in the phase angle of the power grid. Such changes in phase angle caused by disturbances are very similar to those created by tampering of recordings, and thus may result in erroneous tampering detection.

Additionally, the capability of previous efforts to identify the source location of a recording is limited to the size of one interconnected grid. In other words, matching an ENF sequence and/or a phase angle sequence to a reference database is only capable of identifying the power grid interconnection (e.g., Eastern Interconnection (EI), Western Electricity Coordinating Council (WECC), Electric Reliability Council of Texas system (ERCOT)), but not the state, city, or location within a city, where the audio recording took place.

Therefore, the inventors recognized a need in the art for improving the reliability of tampering detection of digital audio recordings and better interpreting the results, and also identifying the source location of the digital audio recordings.

DETAILED DESCRIPTION

Embodiments of the present disclosure provide systems and methods for detecting a tampering and identifying a location of a digital recording. A frequency sequence and a phase angle sequence may be extracted from the digital recording. A portion of the frequency sequence may be matched to one of a plurality of reference frequency sequences, and a portion of the phase angle sequence may be matched to one of a plurality of reference phase angle sequences. Tampering of the digital recording may be detected when the frequency and phase sequences differ from the matched reference sequences. Moreover, a noise sequence may be extracted from the extracted frequency sequence. A location of the digital recording may be identified by matching the noise sequence to one of a plurality of noise sequences of the plurality of reference frequency sequences.

Figure 1:
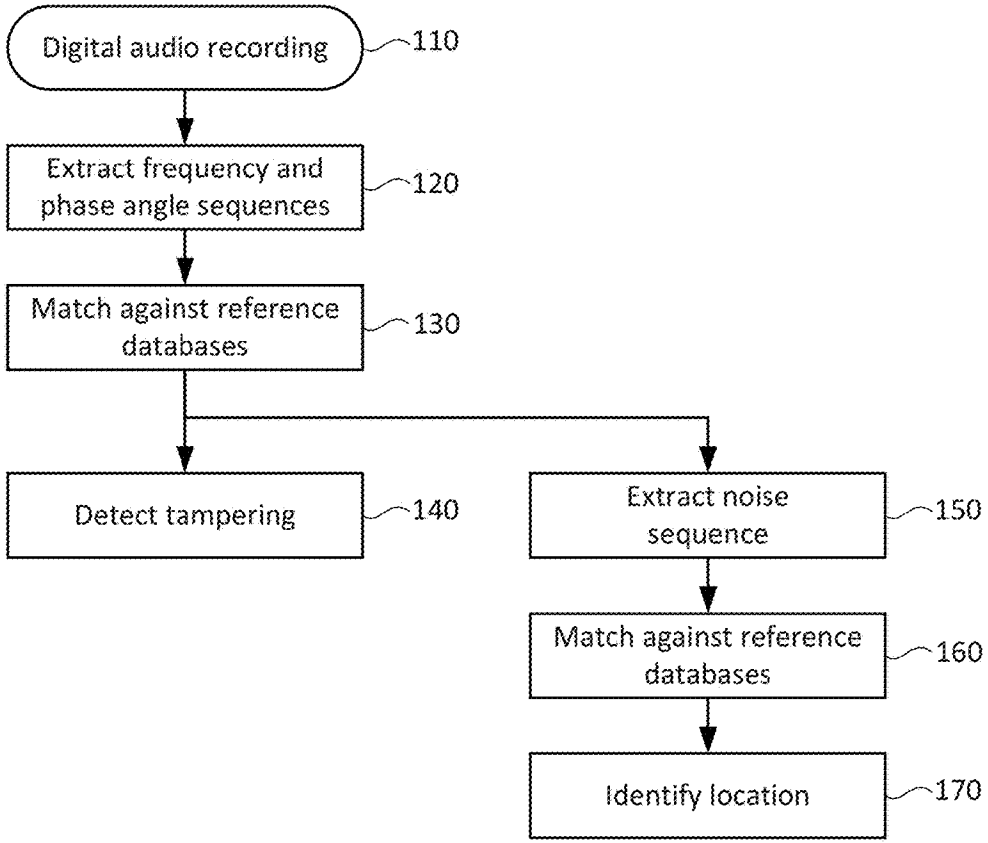
FIG. 1 illustrates a tampering detection and a location identification method of a digital audio recording according to an embodiment of the present disclosure.

FIG. 1 illustrates a tampering detection and location identification method 100 of a digital audio recording according to an embodiment of the present disclosure. The method 100 begins at step 110 with a digital audio recording. At step 120, a frequency sequence and a phase angle sequence may be extracted from the digital audio recording using a short-time Fourier transform (STFT), as will be described below. The frequency and phase angle sequences then may be matched at step 130 against historical frequencies and phase angles recorded in reference databases. The historical frequencies and phase angles may be of major power grid interconnections, such as the Eastern Interconnection (EI), the Western Electricity Coordinating Council (WECC), and the Electric Reliability Council of Texas system (ERCOT). At step 140, based on the matching frequency and phase angle sequences, the method 100 may determine whether or not the digital audio recording has been tampered with.

Further, at step 150 of the method 100, a noise sequence may be extracted from the frequency, which was extracted from the digital audio recording at step 120. At step 160, the extracted noise sequence may be matched against noise sequences of historical frequencies recorded and stored at locations within the major power grid interconnection, which corresponds to the reference database against which the digital audio recording matches. At step 170, based on the matching noise sequences, the method 100 may identify the location where the digital audio recording took place.

Figure 2:
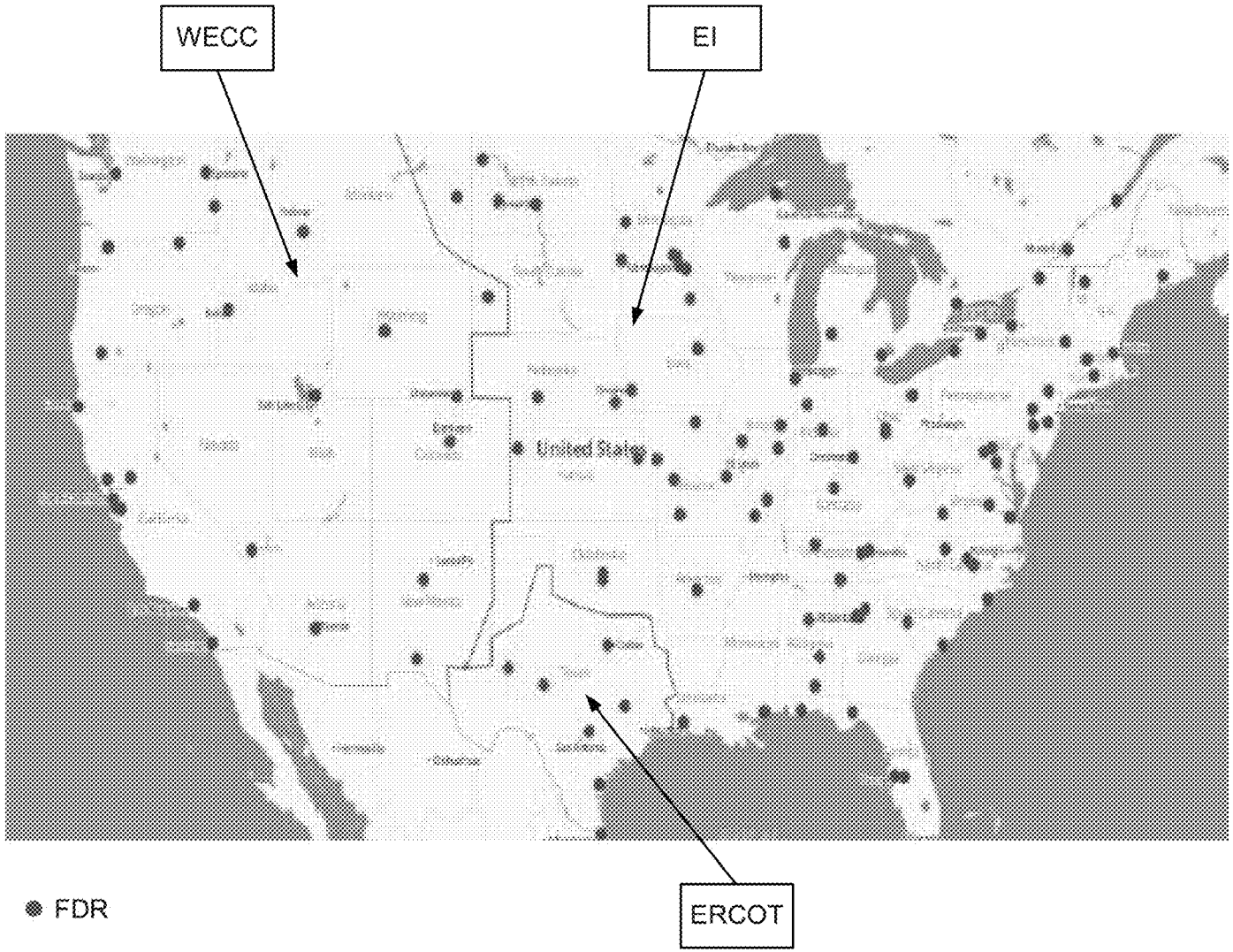
FIG. 2 illustrates a plurality of sensors distributed across North America, according to an embodiment of the present disclosure.

FIG. 2 illustrates a plurality of sensors distributed across North America, according to an embodiment of the present disclosure. The sensors, which are referred to as Frequency Disturbance Recorders (FDRs) by the inventors, may collect highly accurate Global Positioning System (GPS) time-stamped measurements, including frequency and phase angle measurements, at the distribution level of the power grid. An FDR may be an embedded microprocessor system with a GPS receiver and an Ethernet communications system, which may measure frequency and phase angle, from a single-phase electrical outlet. For example, an FDR may have a frequency accuracy of 0.0005 Hz or better.

While the frequency across a major interconnection (e.g., WECC, EI, or ERCOT) is expected to be the same, the noise characteristics among states, cities, and different locations within a city are different due to varying loads, allowing for the location identification of digital audio recordings, as will described below. Although, the distribution of FDRs is shown for North America, the present invention may be applied to any power system worldwide. The FDRs collectively may form a monitoring network.

Figure 3:
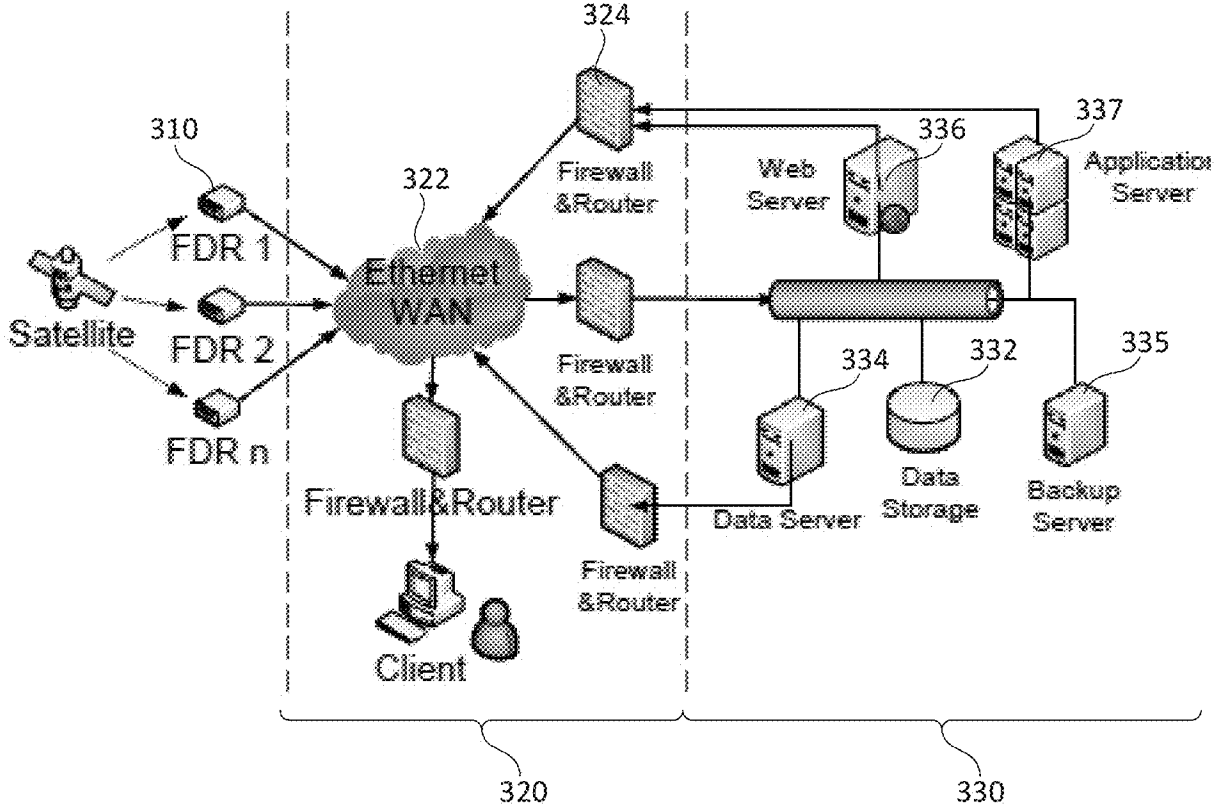
FIG. 3 illustrates an exemplary framework of a monitoring network shown in FIG. 2, according to an embodiment of the present disclosure.

FIG. 3 illustrates an exemplary framework 300 of the monitoring network shown in FIG. 2, according to an embodiment of the present disclosure. The framework 300 of the monitoring network may consist of one or more FDRs 310, which may perform local GPS-synchronized measurements and send data to an information management system (IMS) 330 through the Internet 320. The IMS 330 may collect the data from the FDRs 310, store the data in databases in data storage devices 332, and provide a platform for analysis of the stored data. The Internet 320 may serve as a wide-area communication network (WAN) 322 with a plurality of firewalls/routers 324 to connect the FDRs 310 to the IMS 330. The databases, storing frequency and phase angle measurements from each FDR 310, may represent the reference databases employed by the method 100 of FIG. 1. The servers 334-337 in the IMS 330 may include a plurality of processors to manipulate and analyze the stored data serially and/or in parallel. The data storage devices 332 may include secondary or tertiary storage to allow for non-volatile or volatile storage of measurements (e.g., frequencies and phase angles) from the FDRs. The IMS 330 may be entirely contained at one location or may also be implemented across a closed or local network, an internet-centric network, or a cloud platform.

As discussed, to match a digital audio recording against one of the reference databases, an electric network frequency (ENF) sequence and phase angle sequence need to be extracted from the digital audio recording (e.g., at step 120 of the method 100 of FIG. 1). Given a signal x(n), n=1, 2, . . . , N, to extract an ENF sequence, a short-time Fourier transform (STFT) may be calculated by an M-point discrete Fourier transform (DFT) as in equation (1).

$$STFT_x(m,k)=\sum_{n=1}^{M}x(n)w(n-mP)e^{-j2\pi/Mnk} \tag{1}$$

In equation (1), m=1, 2, . . . , (N−M)/P, k={1, 2, . . . , M}, w is a window function, and P is the size in each step, sometimes called the "hop size." The STFT is a windowed Fourier transform wherein an analyzed signal is truncated by a moving window function.

Generally, in the frequency domain, an N-point DFT of a sinusoidal signal x(n) is a series of discrete samples X(k), which may be expressed as in equation (2).

$$X(k)=\sum_{n=0}^{N-1}x(n)e^{-j\frac{2\pi}{N}nk}=\frac{A}{2}e^{j\theta}e^{j\frac{\pi(N-1)}{N}(1-k)}\frac{\sin\pi(l-k)}{\sin\pi(l-k)/N}+\frac{A}{2}e^{-j\theta}e^{-j\frac{\pi(N-1)}{N}(1+k)}\frac{\sin\pi(l+k)}{\sin\pi(l+k)/N} \tag{2}$$

In equation (2), k={0, . . . , N−1}, A is the amplitude, and θ is the initial phase. A coarse frequency of the signal corresponds to $lf_s/N$, where $f_s$ is the sampling frequency. On right-hand side of equation (2), the first term represents the positive frequency component, while the second term is the negative frequency component. The frequency spectrum may be obtained using the STFT and $k=k_{peak}$ may be found as in equation (3) to correspond to one of the samples X(k) having the largest magnitude.

$$k_{peak}=\arg\max|X| \tag{3}$$

A fractional term δ (e.g., |δ|≤0.5) then may be calculated based on three DFT samples around and including the peak as in equation (4) to refine $k_{peak}$.

$$\delta=\mathrm{Re}\left[\frac{X(k_{peak}-1)-X(k_{peak}+1)}{2X(k_{peak})-X(k_{peak}-1)-X(k_{peak}+1)}\right] \tag{4}$$

The real frequency may correspond to $l=k_{peak}+\delta$. Three bins may be obtained as in equation (5) around the peak value by substituting $k_{peak}$ into equation (2) and letting α=π(N−1)/N.

$$X(k_{peak}-1)=\frac{A}{2}e^{j\theta}e^{j\alpha(\delta+1)}\frac{\sin\pi(\delta+1)}{\sin\pi(\delta+1)/N}+\frac{A}{2}e^{-j\theta}e^{-j\alpha(2k_{peak}+\delta-1)}\frac{\sin\pi(2k_{peak}+\delta-1)}{\sin\pi(2k_{peak}+\delta-1)/N}$$

$$X(k_{peak})=\frac{A}{2}e^{j\theta}e^{j\alpha\delta}\frac{\sin\pi\delta}{\sin\pi\delta/N}+\frac{A}{2}e^{-j\theta}e^{-j\alpha(2k_{peak}+\delta)}\frac{\sin\pi(2k_{peak}+\delta)}{\sin\pi(2k_{peak}+\delta)/N}$$

$$X(k_{peak}+1)=\frac{A}{2}e^{j\theta}e^{j\alpha(\delta-1)}\frac{\sin\pi(\delta-1)}{\sin\pi(\delta-1)/N}+\frac{A}{2}e^{-j\theta}e^{-j\alpha(2k_{peak}+\delta+1)}\frac{\sin\pi(2k_{peak}+\delta+1)}{\sin\pi(2k_{peak}+\delta+1)/N} \quad (5)$$

Since it may be shown that the amplitude of the positive frequency component is much larger than that of the negative frequency component, the negative frequency component may be neglected. Therefore, the amplitude A and the phase angle θ of the signal may be estimated according to the expression of $X(k_{peak})$ las in equation (6).

$$A=\frac{2\pi\delta}{N\sin(\pi\delta)}|X(k_{peak})|$$
$$\theta=\text{angle}(X(k_{peak}))-\alpha\delta \quad (6)$$

The coarse frequency then may be refined as in equation (7) to provide the frequency of the signal.

$$f=\frac{k_{peak}+\delta}{N}f_s \quad (7)$$

Since the ENF always occurs within a certain frequency range (e.g., around 50/60 Hz), to reduce the computation burden, in equation (2), k may be constrained to bins according to a preset frequency range of interest, for example $[f_1, f_2]$. Thus, an adjusted STFT may be represented as in equation (8).

$$STFT_s(m,k)=\sum_{n=1}^{M}x(n)w(n-mP)e^{-j2\pi/Mnk}$$
$$k\in[K_1\quad K_2]$$
$$K_i=f_i\frac{M}{f_x},\ i=1,2. \quad (8)$$

Figure 4:
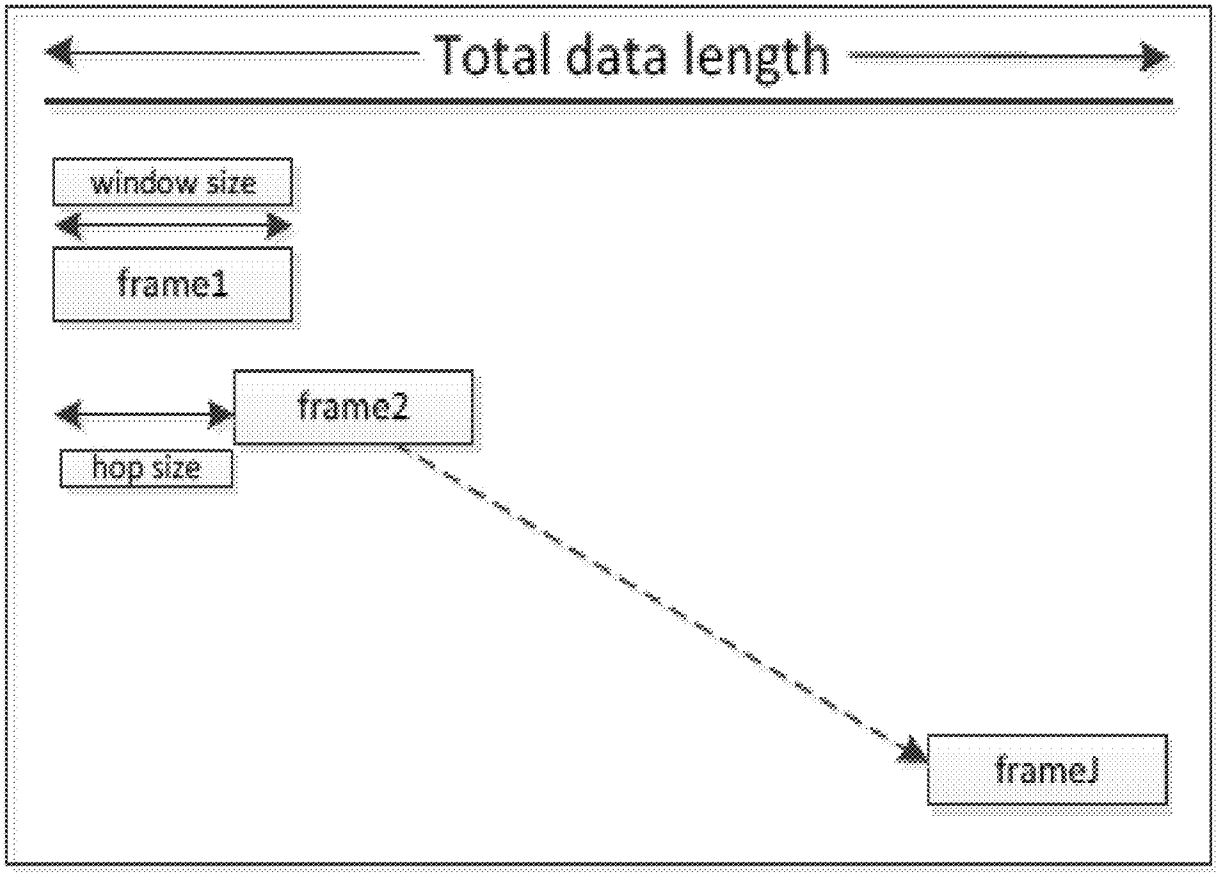
FIG. 4 illustrates a short-time Fourier transform realization, according to an embodiment of the present disclosure.

FIG. 4 illustrates a STFT realization 400, according to an embodiment of the present disclosure. In FIG. 4, a signal may be segmented into frames (e.g., 1 through J). A window size and a hop size are two parameters determining the length and shift of a selected window function. For example, a 10-second window size and 0.1-second hop size may be employed.

Therefore, at step 120 of the method 100 illustrated in FIG. 1, a digital audio signal may further undergo preprocessing that may include a low-pass filtering followed by a signal decimation, and a band-pass filtering to select frequency components that lie in the frequency range $[f_1, f_2]$ from the decimated signal. The band-pass-filtered signal may be segmented into a series of overlapping frames as in FIG. 4 according to the length and step size of the moving window. For each frame, a coarse frequency estimation may be obtained using the STFT and, based on a DFT sample with the largest magnitude, the coarse frequency may be refined as in equation (7). Thus, an ENF sequence may be extracted from the digital audio recording.

After the ENF sequence is extracted from the digital audio recording, the ENF sequence may matched against the reference databases of the monitoring network discussed with respect to FIG. 3. A mean square error (MSE) ε may be used to measure the error between the ENF sequence and reference frequency sequences recorded in the reference databases. For example, the MSE ε may be computed using equation (9).

$$\varepsilon=\log\left(\frac{1}{M}\sum_{i=1}^{M}(ENF(i)-ref(i))^2\right) \quad (9)$$

In equation (9), M is the length of the extracted ENF and ref stands for a reference frequency sequence from one of the reference databases. M may be determined by the hop size. A smaller hop size may result in more frames and consequently a longer ENF sequence. A match may be determined when the MSE E is less than a predetermined threshold.

Figure 5:
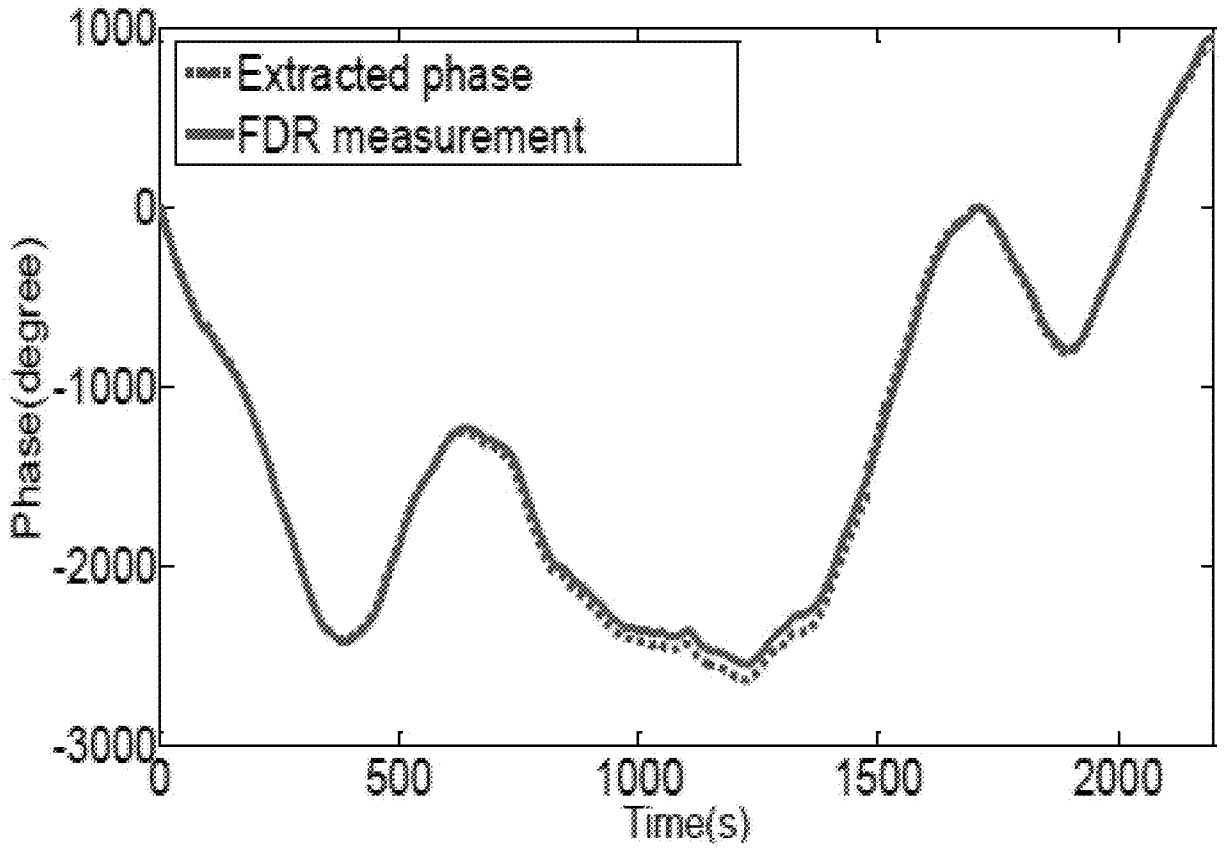
FIG. 5 illustrates an example of an extracted phase angle sequence matching a reference phase angle sequence, according to an embodiment of the present disclosure.

Similarly, at step 120 of the method 100, a phase angle sequence may be extracted from a digital audio recording using a DFT method, as discussed. At step 130, the extracted phase angle sequence may be matched against reference phase sequences. The starting time for the phase angle sequence matching may be obtained from the ENF matching. FIG. 5 illustrates an example of an extracted phase angle sequence matching a reference phase angle sequence measured by an FDR, according to an embodiment of the present disclosure. As can be seen, despite some small drift, there is a good match between the extracted phase angle sequence and the reference phase angle sequence.

Figure 6:
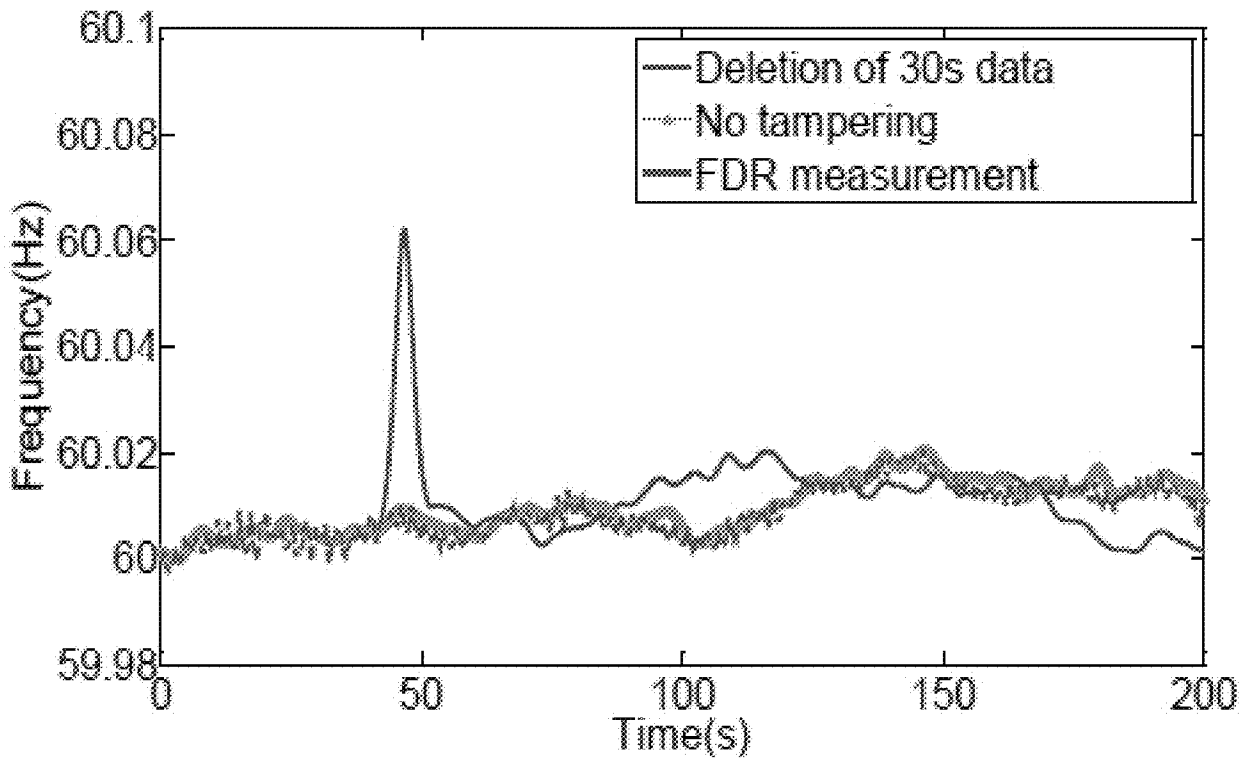
FIG. 6 illustrates a frequency sequence extracted from a digital audio recording having a portion deleted, according to an embodiment of the present disclosure.
Figure 7:
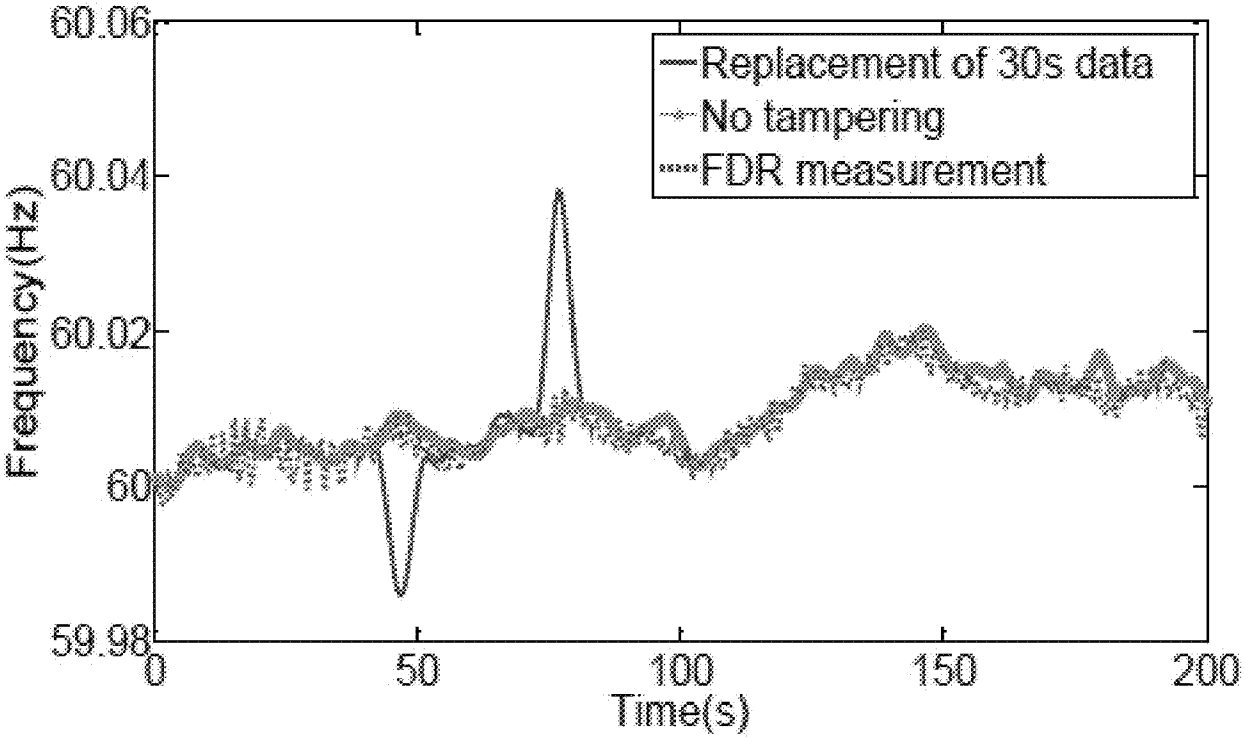
FIG. 7 illustrates a frequency sequence extracted from a digital audio recording having a portion replaced, according to an embodiment of the present disclosure.

Two typical types of tampering are usually of concern—deletion and replacement. FIG. 6 illustrates an ENF sequence extracted from a digital audio recording having a portion deleted, according to an embodiment of the present disclosure. If a portion of a digital audio recording has been deleted, one spike corresponding to the deletion point may be noted in the ENF sequence extracted from the digital audio recording, as in FIG. 6. On the other hand, FIG. 7 illustrates an ENF sequence extracted from a digital audio recording having a portion replaced, according to an embodiment of the present disclosure. If a portion of a recording has been replaced, two spikes corresponding to the beginning and ending points of the replacement may be noted in the ENF sequence, as in FIG. 7. To confirm that spikes in an extracted ENF sequence are either due to deletion or replacement, and not disturbances in the power grid, the ENF should be matched against reference databases. However, only portions of the ENF without the spikes may be used during the matching. Once a matching is obtained, tampering of the digital audio recording may be detected by the absence of spikes in the matching reference sequence.

Figure 8:
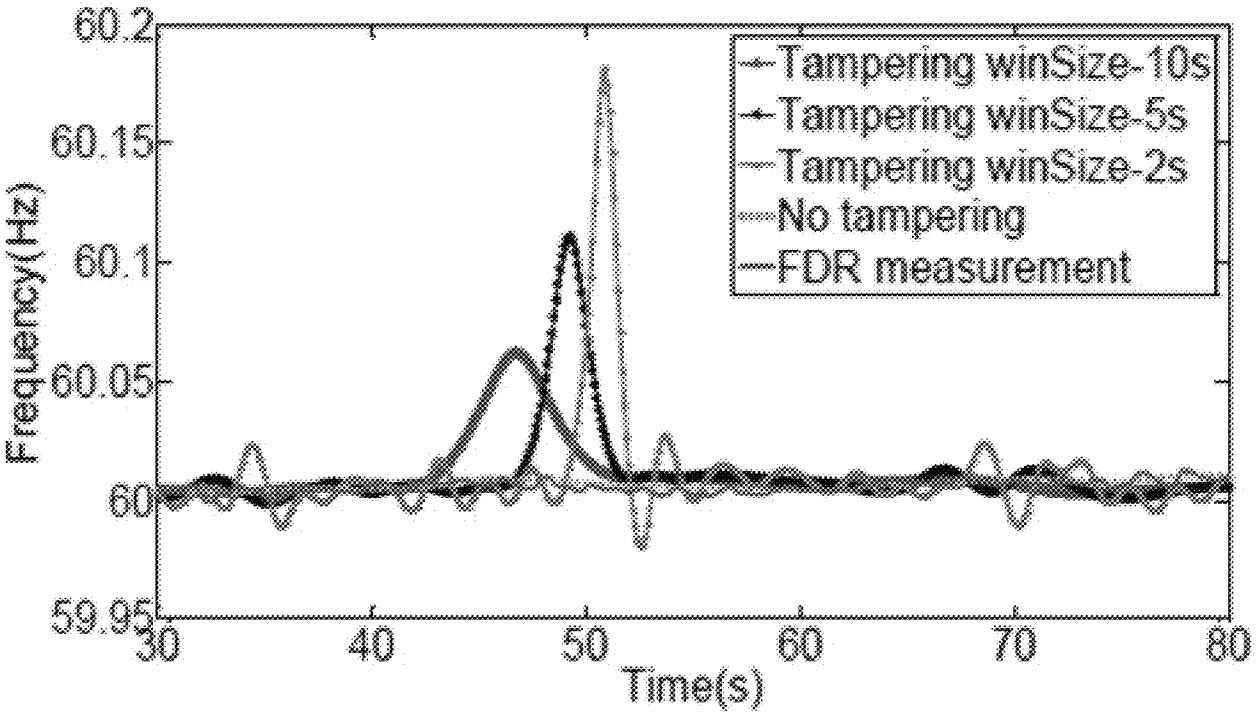
FIG. 8 illustrates a plurality of frequency sequences extracted using different window sizes, according to an embodiment of the present disclosure.
Figure 9:
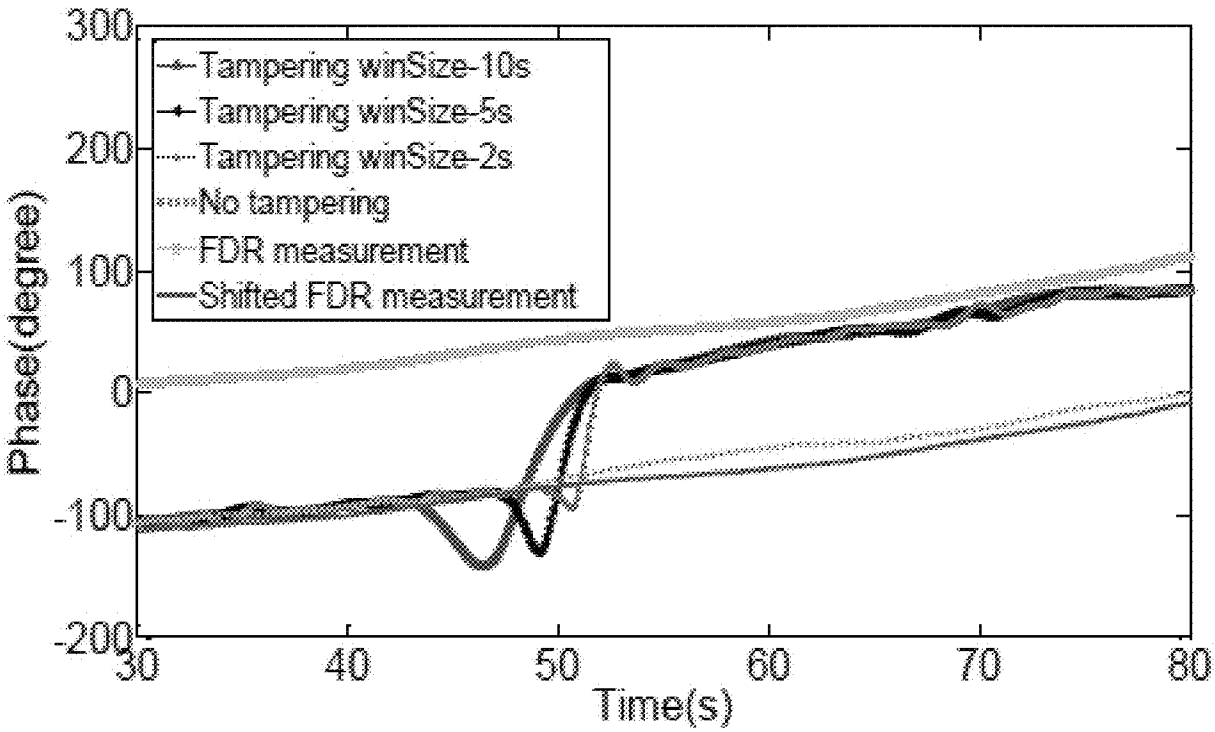
FIG. 9 illustrates a plurality of phase angle sequences corresponding to the same settings as in FIG. 8, according to an embodiment of the present disclosure.

For different ENF and phase angle extraction methods and parameter settings, the ability of detecting tampering using frequency or phase angle may be different. For example, FIG. 8 illustrates a plurality of ENF sequences extracted using different window sizes (are chosen with hop size=0.1 s, deletion length is 30 s), according to an embodiment of the present disclosure. As can be seen in FIG. 8, the frequency change is less obvious as window size increases. Alternatively, FIG. 9 illustrates a plurality of phase angle sequences corresponding to the same settings as in FIG. 8, according to an embodiment of the present disclosure. In FIG. 9, the reference phase angle sequence is shifted vertically to match the starting phase since in different locations the initial phase may be different. As can be seen in FIG. 9, unlike the frequency change, the phase change remains obvious as window size increases.

Figure 10:
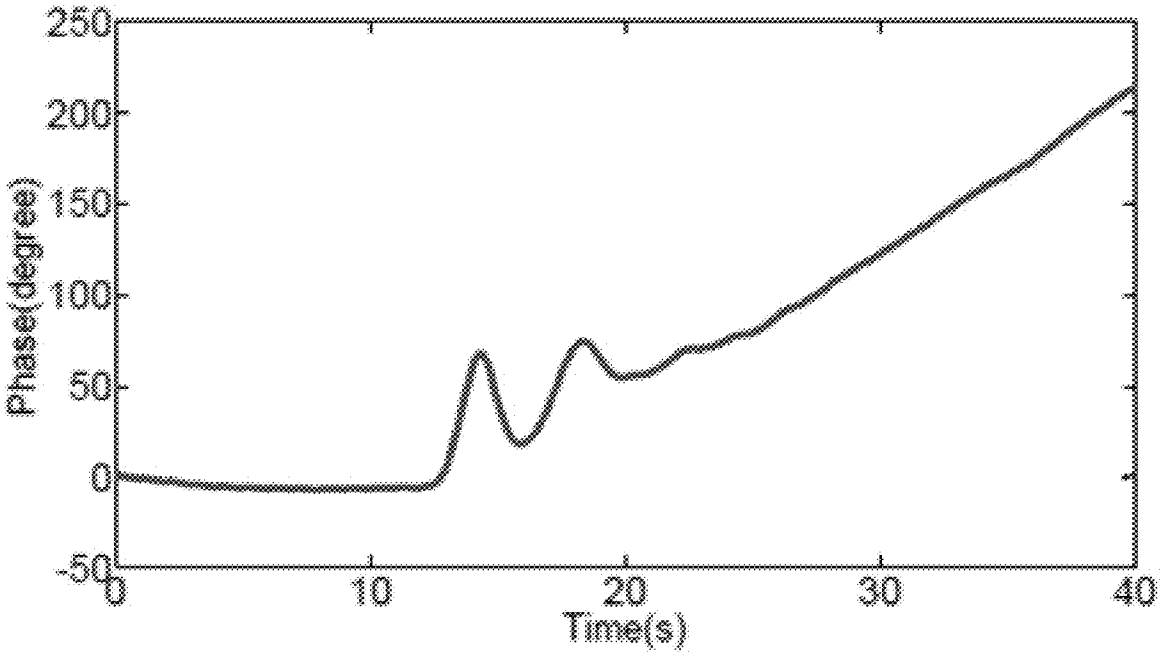
FIG. 10 shows the phase angle recorded in Florida when a line trip happened on Feb. 26, 2008.

On the other hand, in real power grids, there occasionally are sudden phase angle changes due to disturbances. FIG. 10 shows the phase angle recorded by an FDR located in Florida when a line trip happened on Feb. 26, 2008 near the FDR. As can be seen in FIG. 10, the sudden phase angle change caused by the disturbance is similar to that due to tampering of recordings (e.g., FIG. 9). In such cases, only looking for discontinuity of phase angle without a phase angle reference may very likely cause a false tampering detection. Hence, matching a phase angle sequence against a phase angle reference in conjunction with matching an ENF sequence against a frequency reference may improve the reliability of tampering detection.

Figure 11:
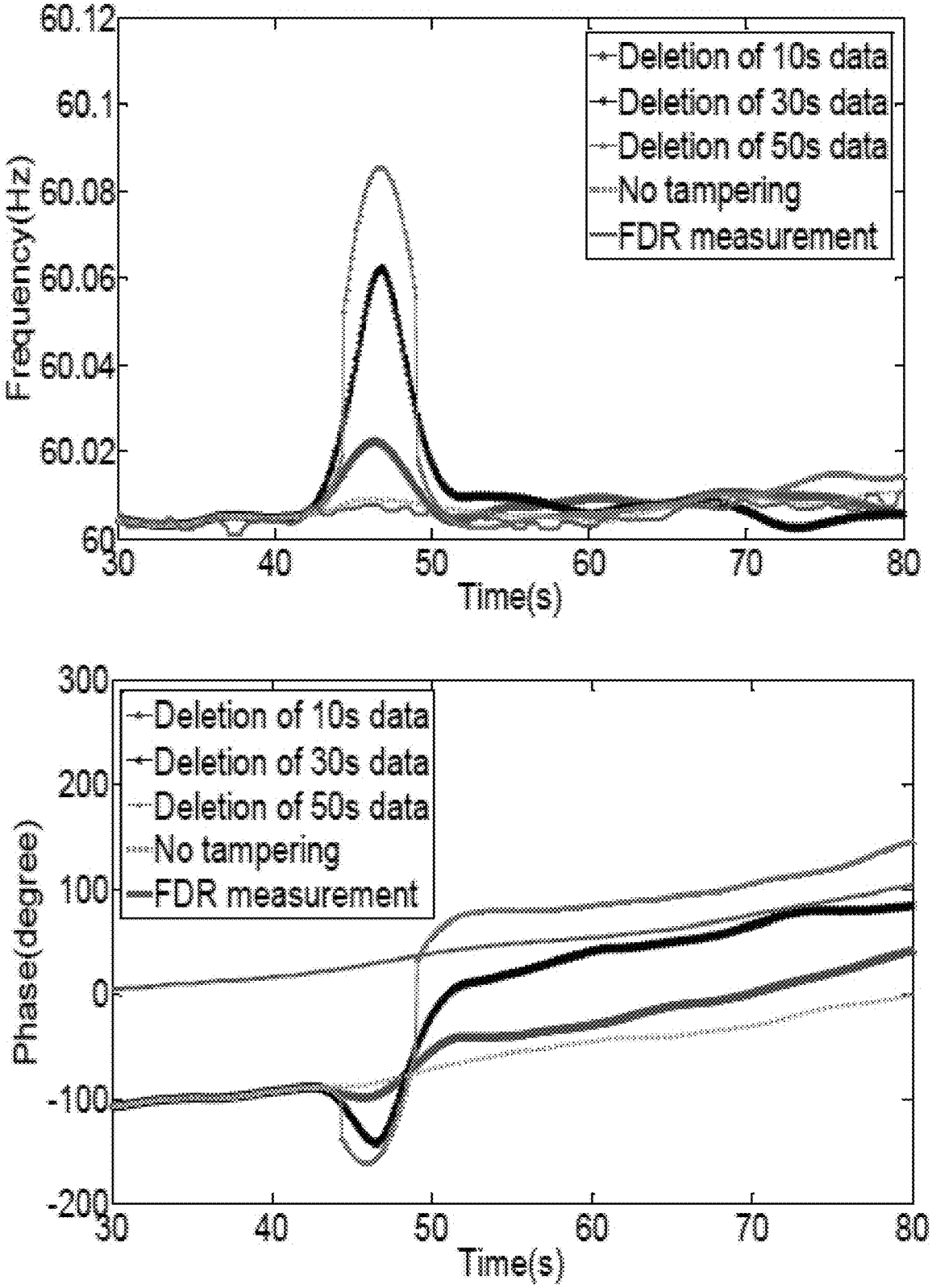
FIG. 11 illustrates an example of tampering detection of a digital audio recording, according to an embodiment of the present disclosure.

FIG. 11 illustrates an example of tampering detection of a digital audio recording, according to an embodiment of the present disclosure. A portion of the recording is deleted. Then, an ENF sequence and a phase angle sequence are extracted as discussed above. FIG. 11 shows the frequency change for different lengths of deletion and the corresponding phase angle change. Besides improving the reliability of tampering, matching a phase angle sequence to a reference database allows for the estimation of the length of deletion.

Figure 12:
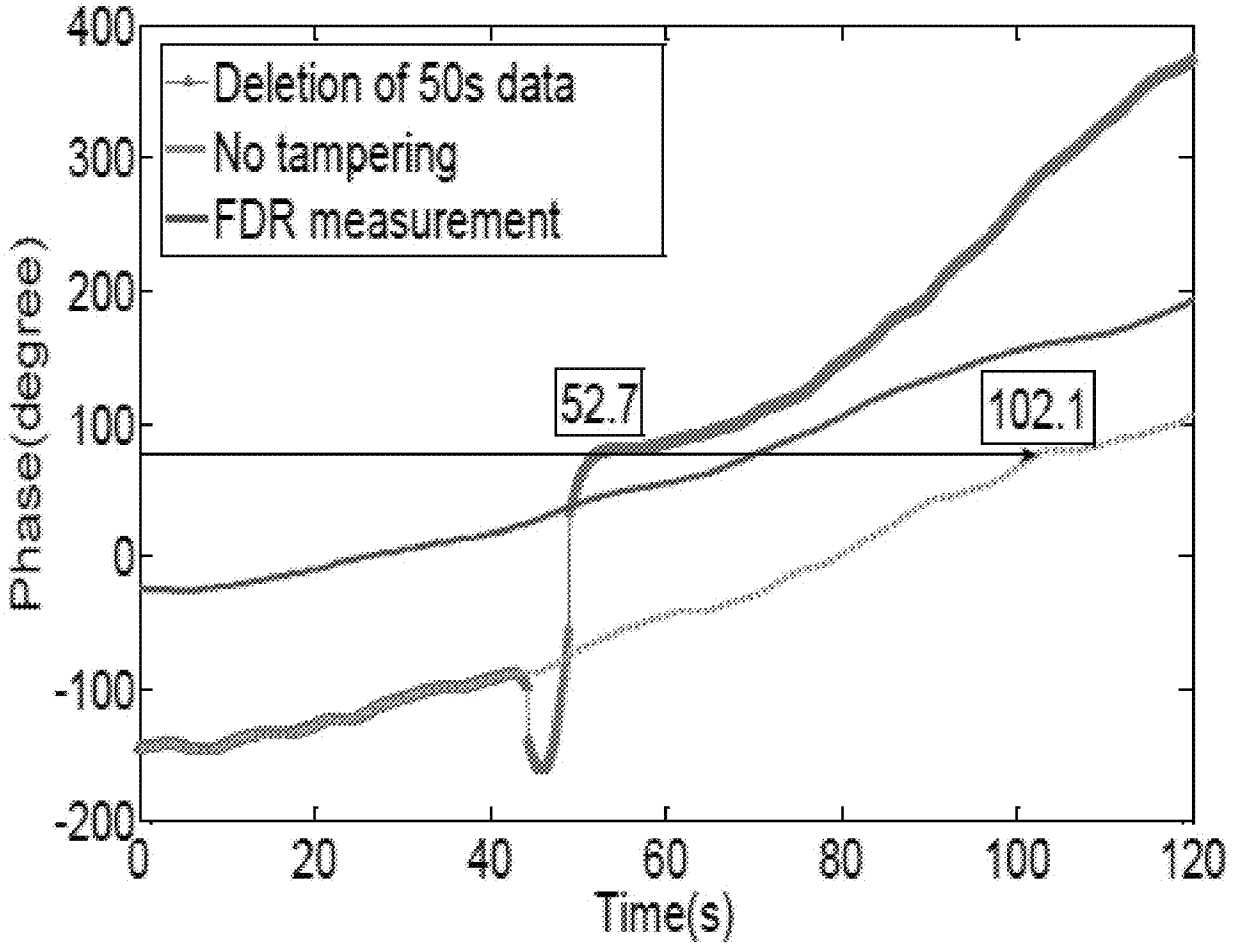
FIG. 12 illustrates an estimation of the length of deletion of a digital audio recording, according to an embodiment of the present disclosure.

FIG. 12 illustrates an estimation of the length of deletion of a digital audio recording, according to an embodiment of the present disclosure. For example, a point corresponding to time=52.7 s right after the abrupt phase change and a point corresponding to time=102.1 s in reference phase having the same phase angle are chosen. Here, the "No tampering" phase angle is used as reference, but a shifted FDR phase angle measurement may also be used. Considering the phase value of tampered recording and reference should be same after the tampering part, the deletion length may be estimated by measuring the time difference between those two points. In this example, the length of deletion may be estimated to be 49.4 s. It is also possible to estimate the deletion length using frequency with a similar procedure, but it is much less straightforward.

Figure 13:
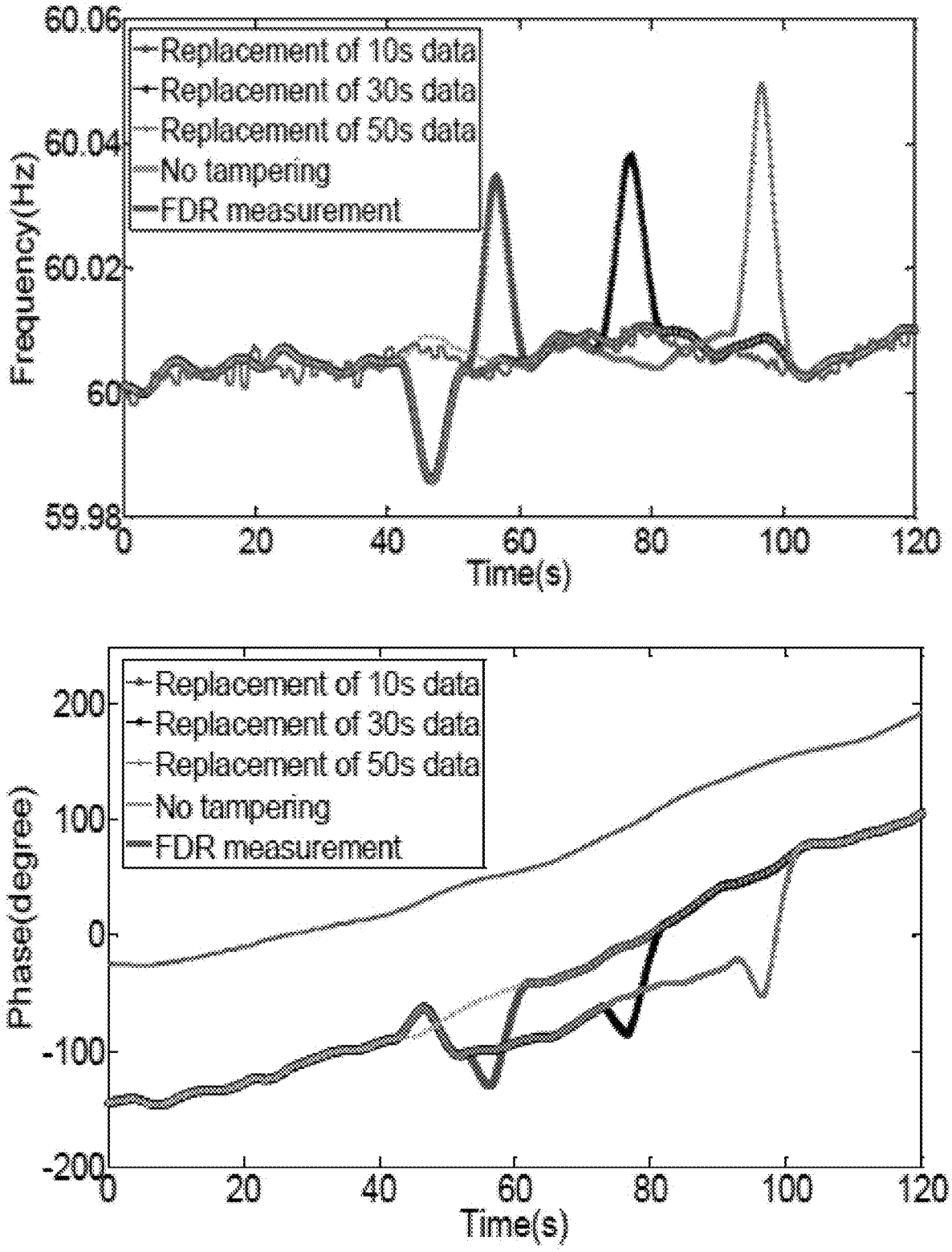
FIG. 13 illustrates an example of tampering detection of a digital audio recording, according to an embodiment of the present disclosure.

FIG. 13 illustrates an example of tampering detection of a digital audio recording, according to an embodiment of the present disclosure. A section of the recording is replaced. FIG. 13 shows the frequency change with different replacement lengths and the corresponding phase angle change. Given that the replacements start at the same time, the starting spikes in the frequency and phase angle sequences overlap. As expected, two frequency and phase angle spikes may be observed. Furthermore, the length of replacement may be estimated using either frequency or phase angle by measuring the time difference between the two corresponding spikes.

Once a frequency matching is obtained (e.g., in step 130 of the method 100), the major power grid interconnection (e.g., WECC, EI, or ERCOT) to which the digital audio recording belong may be known. Further, a location where the digital audio recording took place may be determined within the identified interconnection as discussed next.

Variations among ENF references within the same interconnection have been found to be caused by local load characteristics. While ENF references within the same interconnection follow the same trend, each ENF reference includes a background noise that is location-dependent and shows a unique statistical characteristic in the frequency domain. Therefore, to identify a location where a digital audio was recorded, a noise sequence may be extracted from the ENF sequence, which may be extracted from the digital audio recording (e.g., at step 120 of the method 100). The extracted noise sequence then may be matched against noise sequences of historical frequencies recorded by FDRs in the same interconnection.

Figure 14:
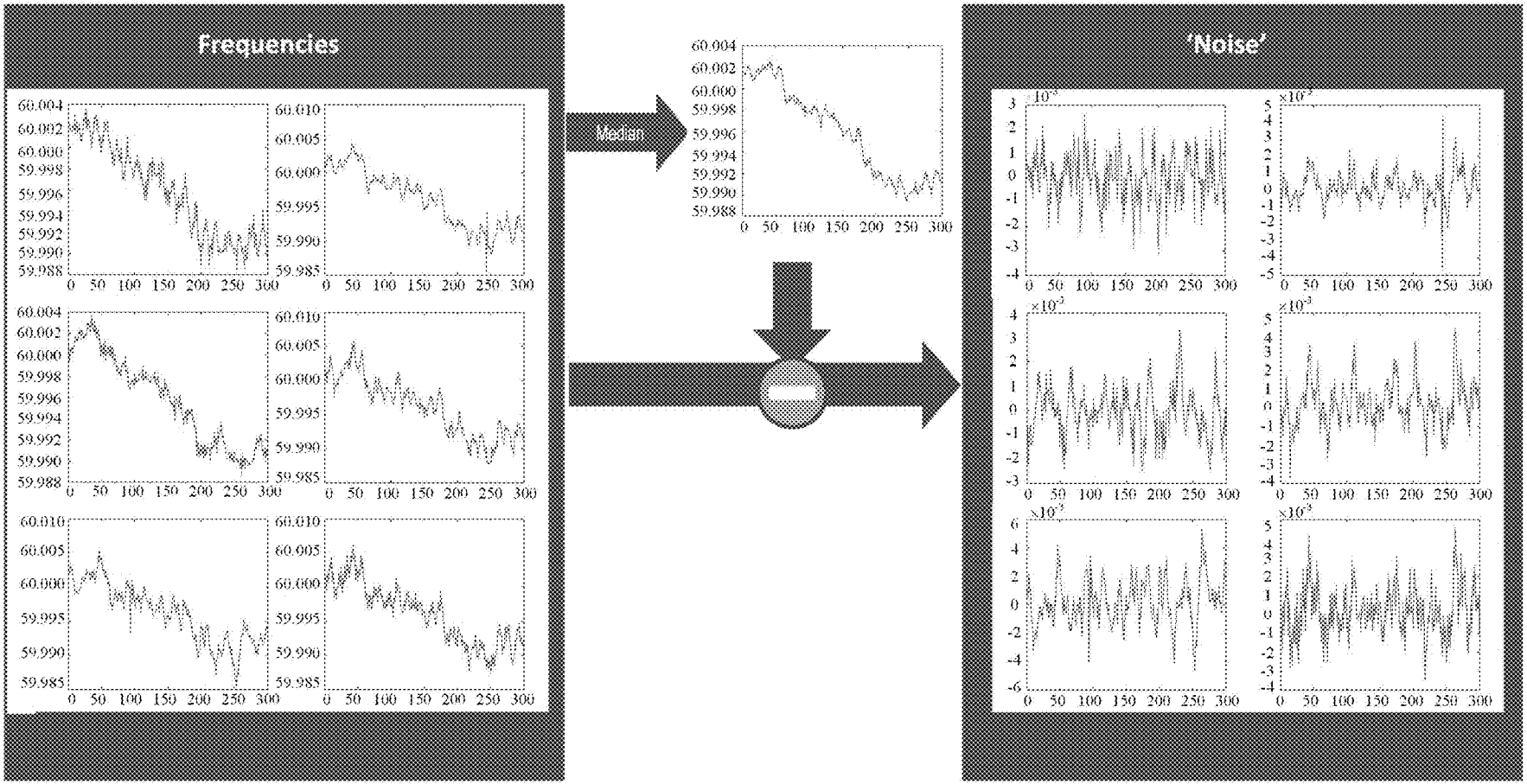
FIG. 14 illustrates an exemplary technique to extract noise sequences from frequency sequences, according to an embodiment of the present disclosure.

FIG. 14 illustrates an exemplary technique 1400 to extract noise sequences from both the ENF sequence of a digital audio recording and frequencies recorded by FDRs, according to an embodiment of the present disclosure. The noise sequences are extracted by removing a common part from the ENF and the frequency sequences. For example, the common part may be obtained by computing the median of all the frequencies sequences. Alternatively, a wavelet function may be employed to extract the noise characteristics.

Figure 15:
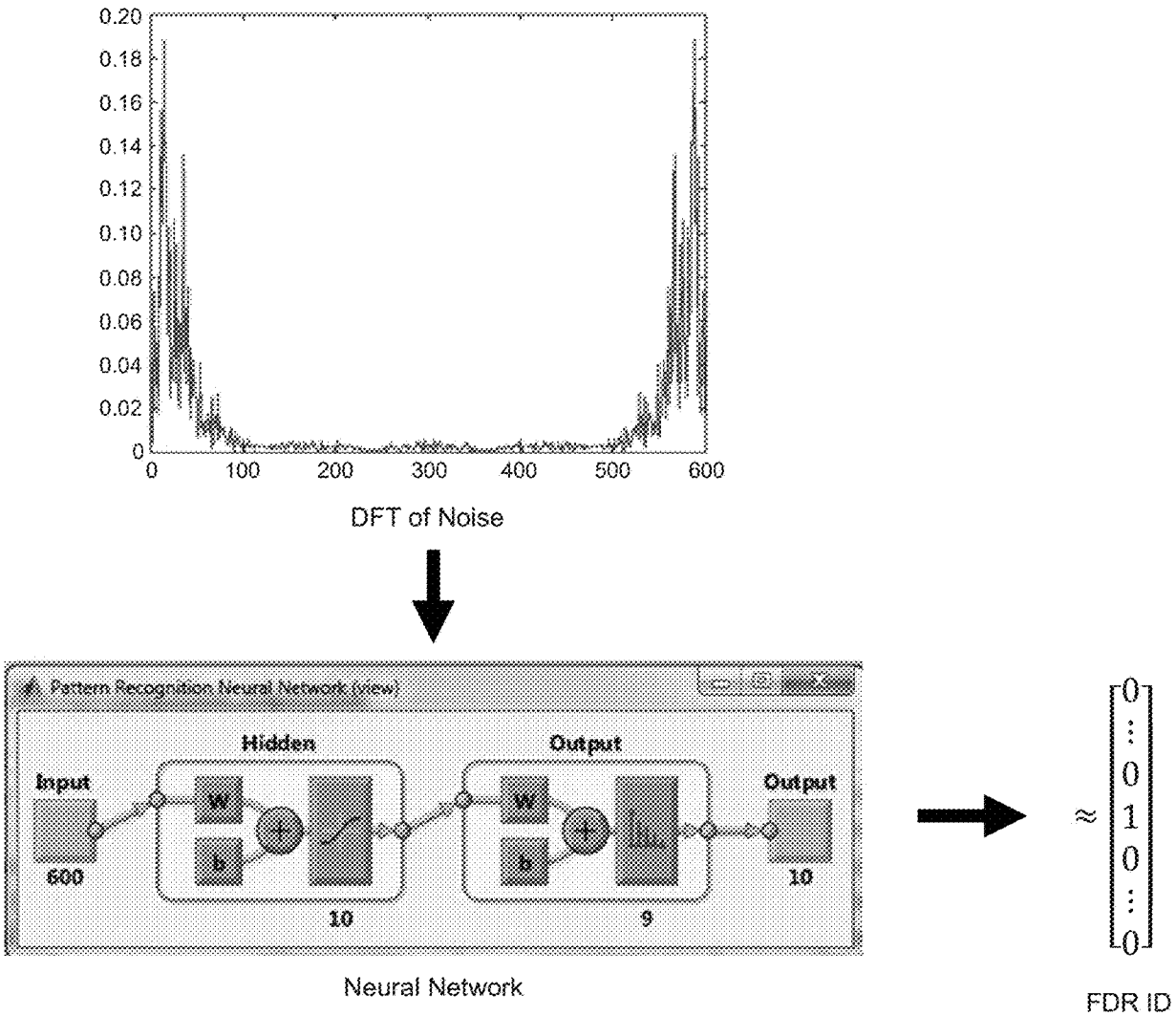
FIG. 15 illustrates an exemplary technique to detect a location of a digital audio recording, according to an embodiment of the present disclosure.

FIG. 15 illustrates an exemplary technique 1500 to detect a location of a digital audio recording, according to an embodiment of the present disclosure. A DFT is first performed on the noise sequence extracted from the ENF sequence of a digital audio recording to generate a frequency spectrum. A neural network may then be used for pattern recognition. Frequency spectra from historical frequency data from FDRs may be used to train the neural network, and the frequency spectrum of the recording may be input into the trained neural network to identify an FDR having a matching frequency spectrum, if any.

Figure 16:
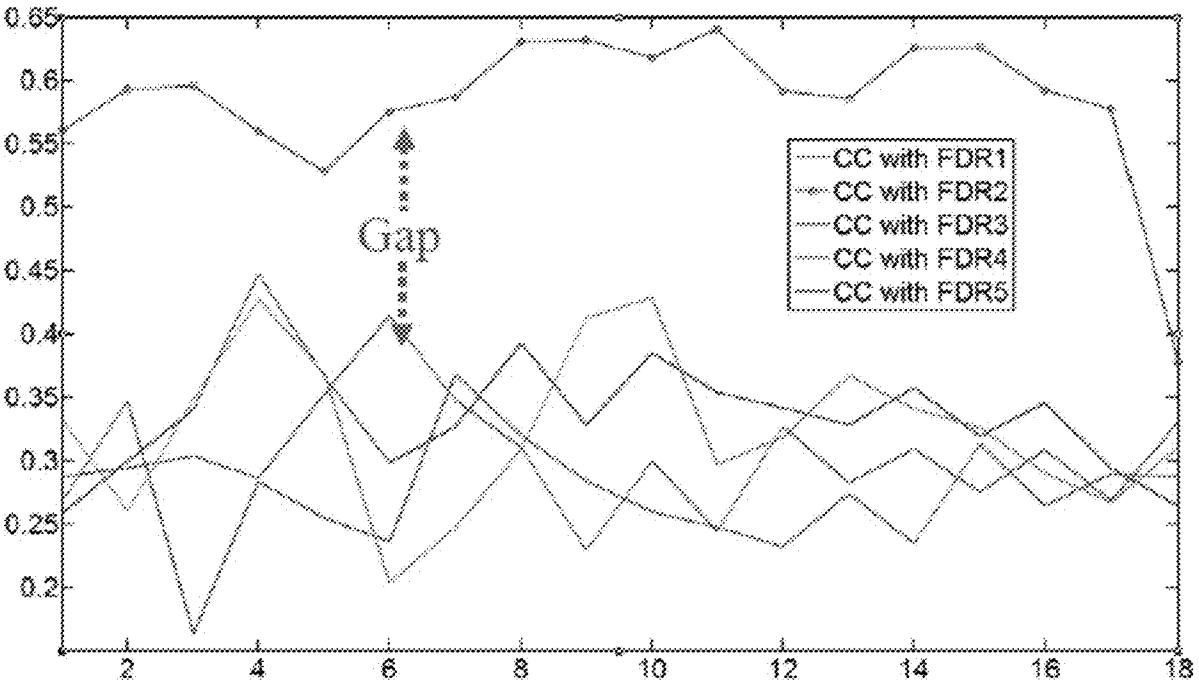
FIG. 16 illustrates exemplary correlation coefficients between a target frequency spectrum and reference frequency spectra, according to an embodiment of the present disclosure.

As an alternative to using a neural network, correlation coefficients may be computed between a target frequency spectrum and reference frequency spectra. High correlation coefficients with respect to one frequency spectrum compared to other frequency spectra may typically indicate a match. FIG. 16 illustrates exemplary correlation coefficients (CCs) between a target frequency spectrum and reference frequency spectra from five FDRs, according to an embodiment of the present disclosure. As can be seen in FIG. 16, the correlation coefficients corresponding to the FDR2 are relatively higher compared to the correlation coefficients corresponding to the other four FDRs. In such a case, it may be concluded that the target frequency spectrum was located in the vicinity of the FDR2.

Thus, if a target frequency spectrum is obtained from the noise extracted from an ENF sequence of a digital audio recording, for example, the location of the digital audio recording may be identified by computing correlation coefficients between the target frequency of the digital audio recording and reference frequency spectra of noises from reference frequency sequences of a plurality of FDRs. Similarly, if a target frequency spectrum is extracted from a frequency sequence recorded by an FDR or any other phasor measurement unit, the frequency sequence may be authenticated, and this may allow for the detection of cyber-attacks on, for example, potentially critical power grid data.

As the number of FDRs increases, the likelihood of finding a match (i.e., the location where the digital audio was recorded) may increase, but the matching processes may take longer. However, the digital aspect of recordings and reference databases may allow for parallel processing, which may considerably speed up the matching processes. For example, an ENF and phase angle sequences extracted from a digital audio recording may be matched in parallel against each of a plurality of frequency and phase angle sequences from reference databases. To speed the matching processes even more, the frequency and phase angle sequences from the reference databases may be divided into a plurality of segments against which the digital audio recording may be matched in parallel.

Several embodiments of the disclosure are specifically illustrated and/or described herein. However, it will be appreciated that modifications and variations of the disclosure are covered by the above teachings and within the purview of the appended claims without departing from the spirit and intended scope of the disclosure. Further variations are permissible that are consistent with the principles described above.

What is claimed is:

1. A method of detecting a tampering and identifying a location of a digital recording, comprising:

extracting a frequency sequence and a phase angle sequence from the digital recording;

matching a portion of the frequency sequence to one of a plurality of reference frequency sequences, and a portion of the phase angle sequence to one of a plurality of reference phase angle sequences;

detecting the tampering of the digital recording when the frequency sequence differs from the matched reference frequency sequence and the phase angle sequence differs from the matched reference phase angle sequence;

extracting a noise sequence from the frequency sequence, wherein extracting the noise sequence comprises removing a common portion of the frequency sequence and the plurality of reference frequency sequences; and identifying the location of the digital recording, wherein identifying the location of the digital recording comprises finding a match between the noise sequence and one of a plurality of noise sequences of the plurality of reference frequency sequences;

wherein the removing the common portion of the frequency sequence and the reference frequency sequences from the frequency sequence comprises:

computing a median of the frequency sequence and the plurality of reference frequency sequences; and subtracting the median from the frequency sequence.

2. The method claim 1, wherein the extracting the frequency sequence and the phase angle sequence from the digital recording comprises using a short-time Fourier transform.

3. The method claim 1, wherein the matching the portion of the frequency sequence to one of the plurality of reference frequency sequences comprises:

computing a mean square error between the portion of the frequency sequence and each of the plurality of reference frequency sequences; and selecting one of the plurality of reference frequency sequences when a corresponding mean square error is less than a predetermined threshold.

4. The method claim 1, wherein the matching the portion of the phase angle sequence to one of the plurality of reference phase angle sequences comprises:

obtaining a starting time from the matching the portion of the frequency sequence to one of a plurality of reference frequency sequences; and selecting one of the plurality of reference phase angle sequences corresponding to the matched reference frequency sequence.

5. The method claim 1, wherein the detecting the tampering of the digital recording comprises detecting a deletion of a portion of the digital recording.

6. The method claim 5, wherein the deletion of a portion of the digital recording is detected when the frequency sequence and the phase angle sequence each includes one spike when compared to the matched reference frequency sequence and the matched reference phase angle sequence, respectively.

7. The method claim 1, wherein the detecting the tampering of the digital recording comprises detecting a replacement of a portion of the digital recording.

8. The method claim 7, wherein the replacement of a portion of the digital recording is detected when the frequency sequence and the phase angle sequence each includes two spikes when compared to the matched reference frequency sequence and the matched reference phase angle sequence, respectively.

9. The method claim 1, wherein the identifying the location of the digital recording comprises:

performing a discrete Fourier transform on the noise sequence to generate a frequency spectrum; and inputting the frequency spectrum into a neural network to match a frequency spectrum of one of the reference frequency sequences.

10. A system, comprising:

at least one electric network;

a plurality of sensors to measure a reference frequency sequence and a reference phase angle sequence for each of a plurality of locations in the at least one electric network; and a computer system including at least one processor and at least one storage device storing the reference frequency sequences, the reference phase angle sequences, and instructions that are executable by the at least one processor to perform operations comprising:

extracting a frequency sequence and a phase angle sequence from a digital recording;

matching a portion of the frequency sequence to one of the reference frequency sequences, and a portion of the phase angle sequence to one of the reference phase angle sequences;

detecting a tampering of the digital recording when the frequency sequence differs from the matched reference frequency sequence and the phase angle sequence differs from the matched reference phase angle sequence;

extracting a noise sequence from the frequency sequence, wherein extracting the noise sequence comprises removing a common portion of the frequency sequence and the plurality of reference frequency sequences; and identifying the location of the digital recording, wherein identifying the location of the digital recording comprises finding a match between the noise sequence and one of a plurality of noise sequences of the plurality of reference frequency sequences;

wherein the removing the common portion of the frequency sequence and the reference frequency sequences from the frequency sequence comprises:

computing a median of the frequency sequence and the plurality of reference frequency sequences; and subtracting the median from the frequency sequence.

11. The system of claim 10, wherein the extracting the frequency sequence and the phase angle sequence from the digital recording comprises using a short-time Fourier transform.

12. The system of claim 10, wherein the matching the portion of the frequency sequence to one of the plurality of reference frequency sequences comprises:

computing a mean square error between the portion of the frequency sequence and each of the plurality of reference frequency sequences; and selecting one of the plurality of reference frequency sequences when a corresponding mean square error is less than a predetermined threshold.

13. The system of claim 10, wherein the matching the portion of the phase angle sequence to one of the plurality of reference phase angle sequences comprises:

obtaining a starting time from the matching the portion of the frequency sequence to one of a plurality of reference frequency sequences; and selecting one of the plurality of reference phase angle sequences corresponding to the matched reference frequency sequence.

14. The system of claim 10, wherein the detecting the tampering of the digital recording comprises detecting a deletion of a portion of the digital recording.

15. The system of claim 10, wherein the detecting the tampering of the digital recording comprises detecting a replacement of a portion of the digital recording.

16. The system of claim 10, wherein the identifying the location of the digital recording comprises:

performing a discrete Fourier transform on the noise sequence to generate a frequency spectrum; and inputting the frequency spectrum into a neural network to match a frequency spectrum of one of the reference frequency sequences.

17. The method of claim 1, wherein the identifying the location of the digital recording comprises:

generating a plurality of correlation coefficients between the noise sequence and the plurality of reference frequency sequences, respectively; and determining that one of the plurality of correlation coefficients generated for one of the plurality of reference frequency sequences is higher than each of other ones of the plurality of correlation coefficients generated for each of other ones of the plurality of reference frequency sequences.

18. The system of claim 10, wherein the identifying the location of the digital recording comprises:

generating a plurality of correlation coefficients between the noise sequence and the plurality of reference frequency sequences, respectively; and determining that one of the plurality of correlation coefficients generated for one of the plurality of reference frequency sequences is higher than each of other ones of the plurality of correlation coefficients generated for each of other ones of the plurality of reference frequency sequences.

19. A method of detecting a tampering and identifying a location of a digital recording, comprising:

extracting a frequency sequence and a phase angle sequence from the digital recording;

matching a portion of the frequency sequence to one of a plurality of reference frequency sequences, and a portion of the phase angle sequence to one of a plurality of reference phase angle sequences;

detecting the tampering of the digital recording when the frequency sequence differs from the matched reference frequency sequence and the phase angle sequence differs from the matched reference phase angle sequence;

extracting a noise sequence from the frequency sequence, wherein extracting the noise sequence comprises removing a common portion of the frequency sequence and the plurality of reference frequency sequences; and identifying the location of the digital recording, wherein identifying the location of the digital recording comprises finding a match between the noise sequence and one of a plurality of noise sequences of the plurality of reference frequency sequences;

wherein the identifying the location of the digital recording comprises:

generating a plurality of correlation coefficients between the noise sequence and the plurality of reference frequency sequences, respectively; and determining that one of the plurality of correlation coefficients generated for one of the plurality of reference frequency sequences is higher than each of other ones of the plurality of correlation coefficients generated for each of other ones of the plurality of reference frequency sequences.

* * * * *